US009988859B2

(12) United States Patent
Baudoin

(10) Patent No.: US 9,988,859 B2
(45) Date of Patent: Jun. 5, 2018

(54) IMPACT DAMPENING APPARATUS

(71) Applicant: KLX ENERGY SERVICES LLC, Houston, TX (US)

(72) Inventor: Toby Scott Baudoin, Rayne, LA (US)

(73) Assignee: KLX ENERGY SERVICES LLC, Houston, TX (US)

( * ) Notice: Subject to any disclaimer, the term of this patent is extended or adjusted under 35 U.S.C. 154(b) by 386 days.

(21) Appl. No.: 14/792,536

(22) Filed: Jul. 6, 2015

(65) Prior Publication Data

US 2016/0002985 A1 Jan. 7, 2016

Related U.S. Application Data

(60) Provisional application No. 62/021,347, filed on Jul. 7, 2014.

(51) Int. Cl.

| | |
|---|---|
| ***E21B 17/07*** | (2006.01) |
| ***E21B 12/00*** | (2006.01) |
| ***E21B 7/00*** | (2006.01) |
| ***E21B 43/119*** | (2006.01) |

(52) U.S. Cl.

CPC ..... *E21B 17/07* (2013.01); *E21B 43/1195* (2013.01)

(58) Field of Classification Search

CPC ..... E21B 17/07; E21B 43/1195

See application file for complete search history.

(56) References Cited

U.S. PATENT DOCUMENTS

| | | | | |
|---|---|---|---|---|
| 3,963,228 | A * | 6/1976 | Karle | E21B 17/07 175/321 |
| 4,186,569 | A * | 2/1980 | Aumann | E21B 17/07 175/321 |
| 4,800,958 | A * | 1/1989 | Haugen | E21B 34/102 166/142 |
| 4,817,710 | A * | 4/1989 | Edwards | E21B 17/07 166/113 |
| 5,205,364 | A * | 4/1993 | Juergens | E21B 7/06 175/321 |
| 7,677,334 | B2 * | 3/2010 | Blount | E21B 4/18 175/107 |
| 2007/0000695 | A1 * | 1/2007 | Laflin | E21B 17/073 175/57 |
| 2007/0000696 | A1 * | 1/2007 | Laflin | E21B 17/073 175/57 |
| 2013/0284446 | A1 * | 10/2013 | Beynet | E21B 17/07 166/345 |

* cited by examiner

*Primary Examiner* — Nicole Coy
(74) *Attorney, Agent, or Firm* — Drinker Biddle & Reath LLP

(57) ABSTRACT

An apparatus for dampening vibrations in a drill string has a tubular housing with an upper sub connected to a first end, having a threaded connection for engagement with the pipe or drillstring. A piston is positioned in the bore of the tubular housing and longitudinally movable in the bore; the dimensions of the piston and bore permit limited fluid flow around the piston. Connected to the piston and extending out of the second end of the housing is a bottom sub. Mating and engaging profiles in the tubular housing and lower sub allow longitudinal movement between them, but no relative rotation. A spring member, which may be a mechanical spring, an elastomeric member, a compressed gas, or some combination thereof, biases the piston and lower sub out of the tubular housing.

20 Claims, 6 Drawing Sheets

IMPACT DAMPENING APPARATUS

FIELD OF THE INVENTION

This invention pertains to downhole equipment for oil and gas wells. More particularly, it pertains to an impact dampening apparatus for use on a wellbore pipe string such as a coiled tubing string and, more particularly, this invention relates to an apparatus that greatly dampens the impact forces of a TCP gun (tubing conveyed perforating gun) or other impact or vibrational devices that deliver blows or oscillations to a tool string in a wellbore.

BACKGROUND OF THE INVENTION

During the drilling, work over, or plug and abandonment of oil and gas producing wellbores, a variety of down hole tools may be attached to a pipe (often referred as a tubular string or drillstring) or coiled tubing string and utilized to perform various functions within the wellbore. Such tools include: hydraulic or mechanical jars, perforating guns, impact devices often referred to as "hammers", or vibration inducing devices often referred to as Agitators™, Oscillators™, Exciters™, Hydro-Pull™, etc. It is often desired to isolate or reduce the impact forces or vibrations from these devices from other downhole tools in the BHA (bottom hole assembly) or from the pipe or coiled tubing string. Many times more than one of the aforementioned devices are utilized in the same BHA thus the impact dampening device may be placed between these devices to prevent damage to one another. Another tool often utilized in a BHA is a hydraulic separation device, sometimes referred to as "hydraulic disconnect", used to release a tool from the pipe or coiled tubing string so that a tool may be left in the wellbore when the pipe or coiled tubing string is removed. It is common to employ a TCP gun (tubing conveyed perforating gun) below the hydraulic separation device. The hydraulic separation apparatus is run in the case that the TCP gun becomes lodged or stuck. The impact of the TCP gun, which utilizes explosive charges, generates heavy blows to the pipe or coiled tubing string, causing fatigue, especially in coiled tubing, and therefore limits the number of impacts that can be delivered before having to exit the wellbore and remove a length of coil. Removing this length of coiled tubing will place any future fatigue inducing stresses into a different location on the coiled tubing string.

Also, the heavy impacts created by the TCP gun are known to be capable of prematurely shearing or separating the hydraulic separation device, which parts the tool string from the pipe or coiled tubing string when not desired. This requires the pipe or coiled tubing string to be removed from the wellbore so that the wellbore may be reentered with a fishing tool in order to latch onto the tool string, taking a great amount of time and adding expense.

Consequently, there is a need for an impact dampening device which will prevent fatigue on a pipe or coiled tubing string, prevent premature separation of the hydraulic separation apparatus, or reduce or eliminate damage to other BHA components.

SUMMARY OF THE INVENTION

The apparatus embodying the principles of the present invention satisfies the aforementioned needs. The preferred embodiment of the impact dampening apparatus comprises a top sub, tubular housing, piston, spring member, spring washer, and bottom sub. The bottom sub and tubular housing contain complementary and mating profiles, for example radial clutches or fingers, to prevent rotation of the bottom sub relative to the tubular housing, thereby producing a means of torque transmission through the tool. It should be noted that other means to prevent relative rotation between components of this impact dampening device may be used such as splines, set screws, balls, key ways and or keys, or any other physical structure that allows relative axial movement while substantially eliminating relative rotation. The piston is concentrically located within the top sub and tubular housing, and is threadably attached to the bottom sub. The spring member, which may be a metal coil type spring or other spring member as disclosed herein, is concentrically located around the upper portion of the piston and within the tubular housing, and is compressed by the lower portion of the piston and the top sub. The terms "upper" or "lower" are merely relative as it can be seen that this device will function in any orientation or orientation relative to a wellbore. It can also be seen that the components of this device can easily be changed in regards to male or female threads, stationary versus moving components, etc. without departing from the scope of this invention.

When an impact from a TCP gun or other impact device is applied to the impact dampening apparatus, the bottom sub forces the piston upwards, which thereby forces wellbore fluid within the bore of the tubular housing to exit the device via port hole(s) in the tubular housing. As the piston continues to move, the spring member compresses with its resistance to the impact increasing as the piston continues to move. The further that the spring member is compressed, the greater the spring member and compressed fluid will work to dampen the impact of the TCP gun or other impact device. In a preferred embodiment, the port holes get smaller in the direction of piston travel to progressively increase the resistance to an impact. This operation is similar to a spring assisted shock absorber.

The dampening device may also be utilized in conjunction with a mud motor to help maintain constant weight on the bit, especially when a vibrating device is used. The impact dampening apparatus has a specific known amount of stroke. Also, the force of the spring member and compressed fluid at different stages of stroke is known and adjustable. Operators would be able to maintain a constant weight on the bit while also having some cushion and flexibility to prevent stalls. This impact dampening device will also prevent or reduce the mud motor from "bouncing" due to vibrations from a vibrating device on the structure being drilled. This greatly increases the contact between the drill bit and the material being drilled thereby significantly increasing the rate of penetration.

DESCRIPTION OF SOME OF THE PRESENTLY PREFERRED EMBODIMENTS

With reference to the figures, some of the presently preferred embodiments of the invention can now be described.

Figure 1:
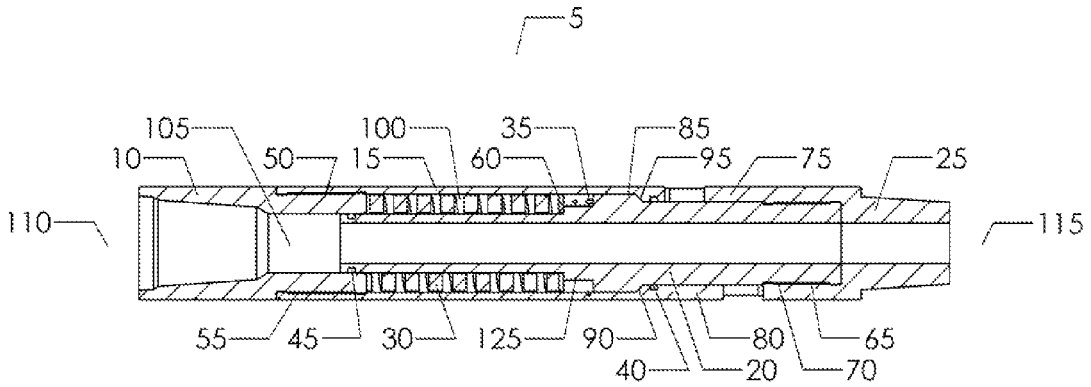
FIG. 1 is a longitudinal cross-sectional view of a first embodiment of an impact dampening apparatus.
Figure 2:
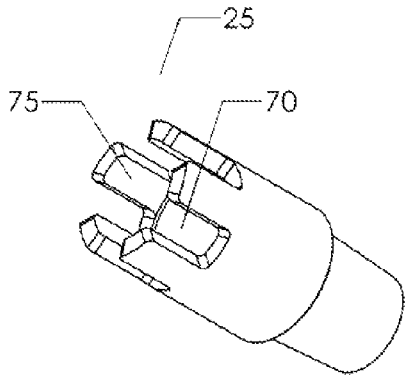
FIG. 2 is an isometric view of the bottom sub of the impact dampening apparatus shown in FIG. 1.
Figure 3:
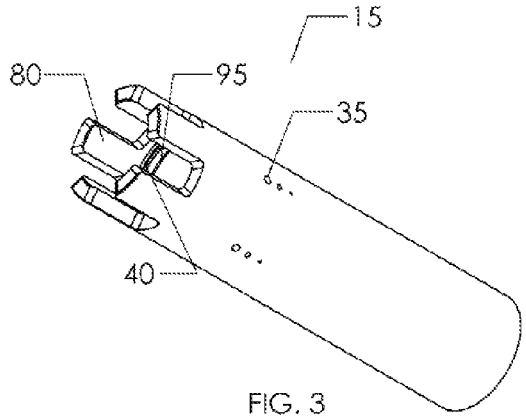
FIG. 3 is an isometric view of the tubular housing of the impact dampening apparatus shown in FIG. 1.
Figure 13:
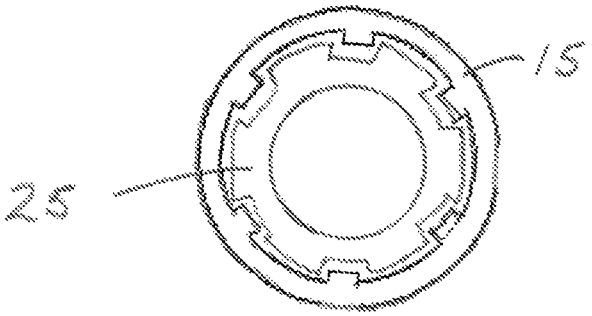
FIG. 13 is a cross section of an exemplary spline connection, forming the mating profiles between the tubular housing and the bottom sub.

The impact dampening apparatus (5) as shown in FIG. 1 is configured for threaded engagement to a drillstring or coiled tubing string on its upper end (110) and to a BHA (including a TCP gun or other impact device) on its lower end (115). The upper sub (10) contains a thread (50) on its lower end for engagement to the tubular housing (15). Fluid travelling through the drillstring enters the impact dampening apparatus (5) through bore (105). Piston (20) is concentrically located within tubular housing (15) and is sealed within bore (105) of upper sub (10) via seal (45). The lower end of piston (20) has a threaded connection (65) which mates with threaded connection (70) of bottom sub (25). The upper portion of head (85) of piston (20) preferably contains wrench flats (125) to aid in the assembly of piston (20) to bottom sub (25). Bottom sub (25) is prevented from rotation (relative to tubular housing 15) via mating profiles in each of bottom sub 25 and tubular housing 15, for example fingers or clutches (75), as better seen in FIG. 2. These fingers or clutches (75) mate or interlock with fingers or clutches (80) of tubular housing (15). Fingers or clutches (80) of tubular housing (15) can be seen more clearly in FIG. 3. It is understood that the mating profiles between bottom sub 25 and tubular housing 15 may comprise splines, set screws, balls, key ways and or keys, or any other physical structure that allows relative axial movement while substantially eliminating relative rotation. For example, FIG. 13 is a cross section view of a spline connection between tubular housing 15 and bottom sub 25, comprising the mating connection between those two members which permits longitudinal movement between them but prevents relative rotation.

A number of port hole(s) (35) extend through the tubular housing (15), allowing for wellbore fluid to enter into and/or exit the bore (100) of tubular housing (15). Tubular housing (15) is shown to utilize three rows of port hole(s) (35), each row being of a different size port(s). However, the number of rows, the number of port hole(s) (35) per row, the size of port hole(s) (35), and location of rows can vary. Seal (40), located on the lower end of tubular housing (15), prevents fluid from entering the tubular housing (15) from the lower end while also disallowing fluid from the bore (100) of tubular housing (15) to escape through the lower end of tubular housing (15). Spring washer (60) is concentrically located within tubular housing (15) and seats against the uppermost face of head (85) of piston (20). Spring washer (60) provides a larger, uniform surface area for spring (30) to compress against, rather than the irregular upper face of head (85) due to wrench flats (125). The upper end of spring member (30) rests against the lowermost face of upper sub (10). Spring member (30) can be of any type of mechanical spring (usually made from a metal alloy) such as a wire form spring, coiled spring, disc spring, etc. The initial preloaded force of spring member (30) against washer (60) urges piston (20) to the lower end (115) of impact dampening apparatus (5), so that face (90) of piston (20) is in contact with face (95) of tubular housing. At this point, impact dampening apparatus (5) is fully extended and uncompressed.

Figure 4:
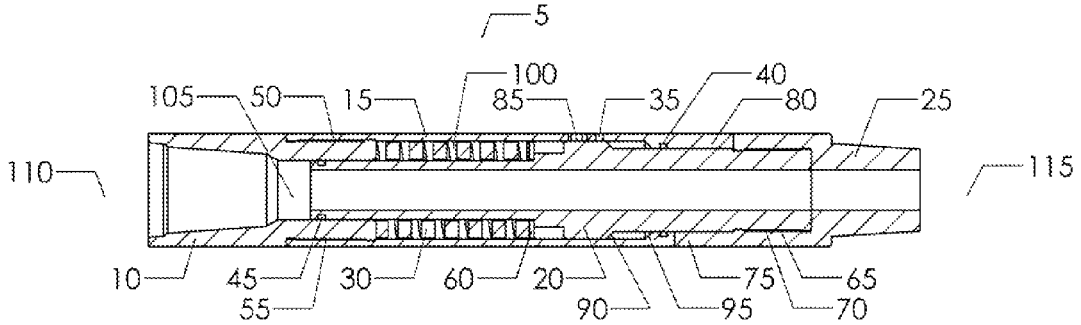
FIG. 4 is a longitudinal cross-sectional view of the impact dampening apparatus shown in FIG. 1 in the fully compressed position.

FIG. 4 shows the impact dampening apparatus (5) at a fully compressed state. As a TCP gun or other impact device is fired, a force is applied to the lower end (115) of impact dampening apparatus (5). Once the force of impact overcomes the initial preloaded force of spring member (30), bottom sub (25) is urged towards the upper end (110) of impact dampening apparatus (5). This causes piston (20) to also be urged upwards, which begins to compress spring member (30) as well as the fluid within bore (100) of tubular housing (15). As piston (20) is urged upwards, the fluid within bore (100) of tubular housing (15) is pressurized, which causes it to be forced back through port holes (35) and into the wellbore. As piston (20) continues to be urged upwards, head (85) of piston (20) begins to block off the port holes (35) of tubular housing (15). The pressure within bore (100) of tubular housing (15) continuously increases as piston (20) is urged upwards and sequentially blocks off the multiple rows of port holes (35). Also, as seen most clearly in FIG. 3, the size of port holes (35), and consequently the flow area available therethrough, decreases in each row from the lower end to the upper end of tubular housing (15). As head (85) of piston (20) blocks off the first (largest) row of port holes (35), the pressure will increase greatly because the sequential rows of port holes (35) (arranged circumferentially around tubular housing 15) will be smaller in size. For every row of port holes (35) blocked off by head (85) of piston (20), the remaining rows of port holes (35) will be smaller in diameter, which will greatly increase the pressure of fluid within bore (100) of tubular housing (15) and increase the resistance to movement. It is to be understood that the decreasing flow area available as piston 20 moves upwardly in the tubular housing 15 may be by decreasing diameter of port holes 35, and/or by a reduced number of port holes 35 in each circumferential row.

As the pressure increases within bore (100) of tubular housing (15), the force required to continue urging the piston upwards is increased. Once the port holes (35) are fully blocked off and/or clutches (75) and (80) have fully interlocked, the combined force of the pressurized fluid within bore (100) of tubular housing (15) along with the spring force of spring member (30) will neutralize the force of impact from the TCP gun or other impact device. It is to be understood that the fit of piston 20 within bore 100, while a tight fit, does permit some limited fluid flow by or around piston 20 as it moves in bore 100 (particularly as it moves beyond a position in which port holes 35 are completely blocked), thereby avoiding a "hydraulic lock" situation. By neutralizing the force of impact from the TCP gun or other impact device, a disconnecting device placed above the impact dampening apparatus (5) on a tool string will be exempt from such impact, thus preventing premature shearing of the disconnecting device. Also, the reduction of tensile load on the pipe or coiled tubing string caused by the TCP gun or other impact device will prevent fatigue caused by such impacts.

Figure 5:
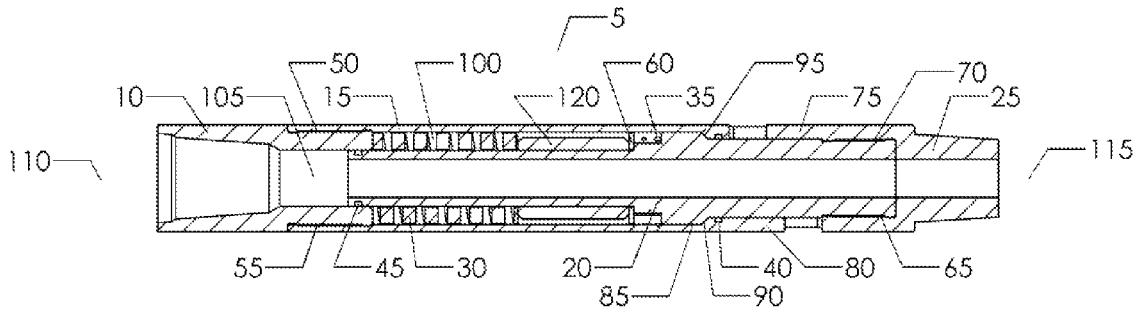
FIG. 5 is a longitudinal cross-sectional view of a second embodiment of the impact dampening apparatus.

FIG. 5 represents a second embodiment of an impact dampening apparatus (5), which utilizes an elastomeric element (120) along with the original coiled spring member (30) and port holes (35) to dampen the impact of force caused by a TCP gun or other impact device placed below it on a tool string. Elastomeric element (120) is shown to be placed above spring (30) in this embodiment but the location of the elastomeric element (120) and spring member (30) may be interchanged. The elastomeric element (120) can be of any elastomeric material such as a polyurethane, urethane, etc. Elastomeric element (120) provides a soft compressible cushion to spring member (30), allowing it to absorb more force from impact. As spring member (30) begins to compress due to the piston being urged upwards, the force of spring member (30) against elastomeric element (120) will overcome the yield of elastomeric element (120), causing it to compress in conjunction with spring member (30).

Figure 6:
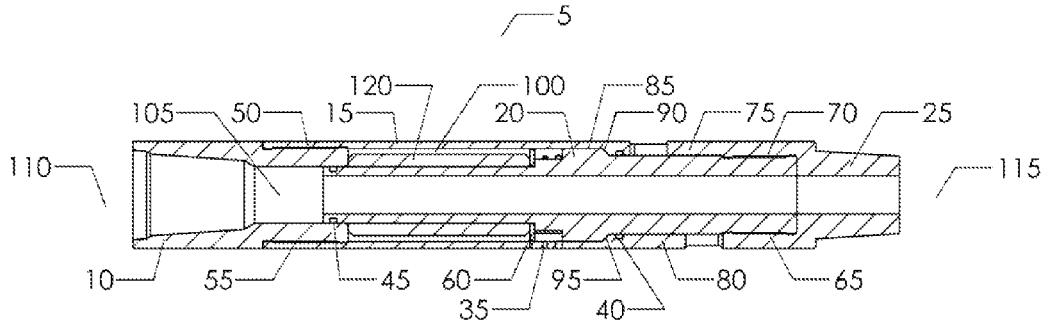
FIG. 6 is a longitudinal cross-sectional view of a third embodiment of the impact dampening apparatus.

FIG. 6 represents a third embodiment of an impact dampening apparatus (5), which only utilizes an elastomeric element (120) in conjunction with port holes (35) to dampen the force of impact from a TCP gun or other impact device. As piston (20) is urged upwards, the force of the TCP gun or other impact device firing overcomes the yield of elastomeric element (120), thus causing it to compress in conjunction with the wellbore fluid within bore (100) of housing (15). The elastomeric element (120) acts as a cushion to absorb the force of impact created by the TCP gun or other impact device. The elasticity of elastomeric element (120) will act as a spring to shuttle the piston (20) along with bottom sub (25) back down to the uncompressed state after the impact has been fully neutralized.

Figure 7:
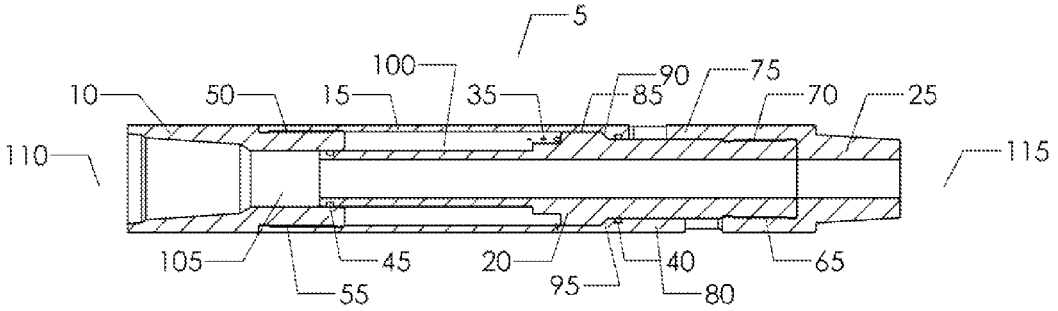
FIG. 7 is a longitudinal cross-sectional view of a fourth embodiment of the impact dampening apparatus.

FIG. 7 is a representation of a fourth embodiment of an impact dampening apparatus (5) which relies solely on the compression of the wellbore fluid within bore (100) of tubular housing (15) to dampen the force of impact created by a TCP gun or other impact device below the impact dampening apparatus (5). When an impact created by a TCP gun or other impact device is applied to the bottom sub (25) and piston (20), the piston (20) will be forced upwards and seal off the port holes (35) of tubular housing (15) and compress the fluid within bore (100) of tubular housing (15) in order to dampen the force of impact. After the force has been neutralized, the pressurized fluid within bore (100) of tubular housing (15) will force the piston (20) along with the bottom sub (25) back to its original uncompressed state.

A tubular housing (15) having no port holes (35) may also be utilized in this embodiment or in conjunction with the aforementioned embodiments.

Figure 8:
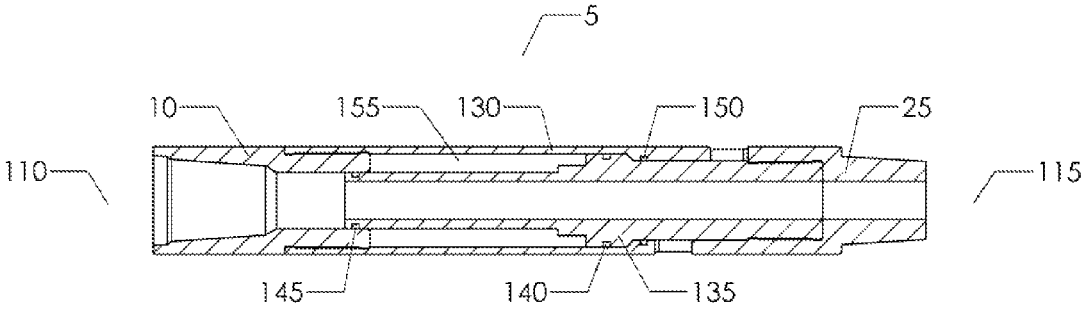
FIG. 8 is a longitudinal cross-sectional view of a fifth embodiment of the impact dampening apparatus.

FIG. 8 represents a fifth embodiment of an impact dampening apparatus (5) utilizing a compressible air or fluid, effectively acting as a spring member, to dampen the impact of a TCP gun or other impact device. The bore (155) of tubular housing (130) is sealed on the upper end via seal (145) of piston (135) and on the lower end via seal (140) of piston (135). The bore (155) of tubular housing (130) can then be filled with any form of compressible air or liquid such as atmospheric air, nitrogen, argon, etc. Once a force from impact is applied to the bottom sub (25) and piston (135), piston (135) will then be urged upwards. As piston (135) moves upwards, it will then compress the air or fluid column within bore (155) of tubular housing (130). The further upwards that piston (135) travels, the more pressurized the air or fluid column within bore (155) of tubular housing (130) becomes. Piston (135) will continue to travel upwards until the pressure from the column of air or fluid within bore (155) of tubular housing (130) neutralizes the force from the impact of the TCP gun or other impact device. After the force from impact has been neutralized, the pressure build-up within bore (155) of tubular housing (130) will force the piston (135) back downwards until it reaches its initial uncompressed state.

Tubular housing (130) and piston (135), along with the utilization of a compressible column of air or fluid, can be used in conjunction with the aforementioned impact dampening apparatuses (5) as seen in FIGS. 1, 4, 5, and 6. The apparatuses (5) would not rely on an unknown wellbore fluid for compression and pressurization; rather, they would rely on a specific type of compressible air or fluid with a known compression rate possibly in conjunction with a spring member (30) and/or an elastomeric element (120) with known rates. This would allow for accurate calculations of how much compression and pressurization is needed in order to best neutralize the impact of a TCP gun or other impact device.

Figure 9:
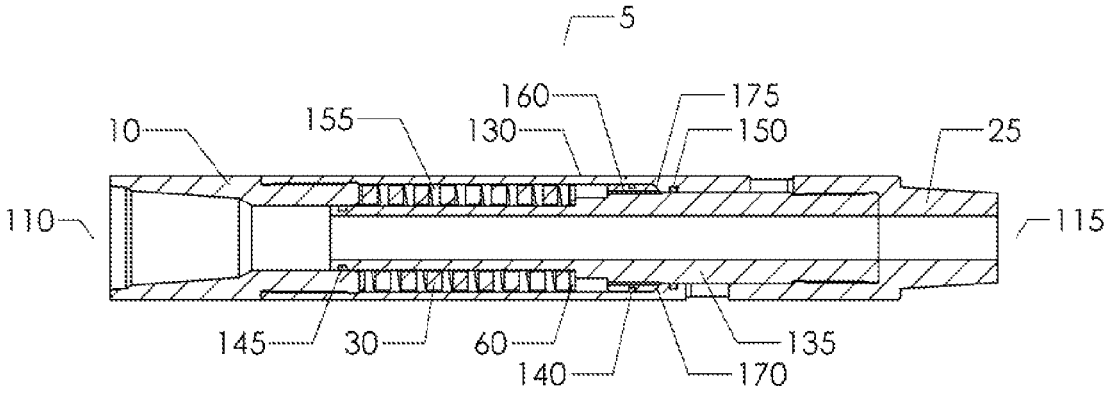
FIG. 9 is a longitudinal cross-sectional view of a sixth embodiment of the impact dampening apparatus.

FIG. 9 illustrates a sixth embodiment of an impact dampening apparatus (5) utilizing a fluid within bore (155) of tubular housing (130), piston (135), weep hole(s) (160) of piston (135), and spring member (30) to dampen the impact of a TCP gun or other impact device. The fluid within bore (155) of tubular housing (130) can be of any compressible or non-compressible fluid such as oil, a liquid and gas combination, wellbore fluid, etc. Weep hole(s) (160) of piston (135) can be of any number and size. The number and size of weep hole(s) (160) along with the stiffness of spring member (30) dictate the speed at which piston (135) travels.

Spring member (30) forces piston (135) to the lower end (115) of impact dampening apparatus (5) so that face (170) of piston (135) rests against face (175) of tubular housing (130). As a force is applied to the lower end (115) of impact dampening apparatus (5) overcomes the force of spring member (30), piston (135) will begin to move upwards. As piston (135) is being forced upwards, face (170) of piston (135) and face (175) of tubular housing (130) will begin to separate; allowing fluid from bore (155) to travel through weep hole(s) (160) and into the annulus created by the separation of faces (170) and (175) of piston (135) and tubular housing (130), respectively. Seal (140) of piston (135) and seal (150) of tubular housing (130) prevent the fluid from escaping the annulus between piston (135) and tubular housing (130). The size and number of weep hole(s) (160) control the speed at which piston (135) travels upwards. As the force from the impact of the TCP gun or other impact device is dampened, spring (30) will force piston (135) downwards, forcing the fluid back through weep hole(s) (160) and into bore (155) of tubular housing (130).

Figure 10:
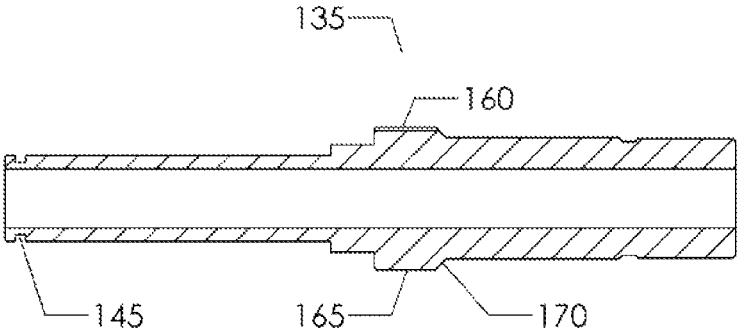
FIG. 10 is a longitudinal cross-sectional view of a second embodiment of the piston of the impact dampening apparatus shown in FIG. 9.
Figure 11:
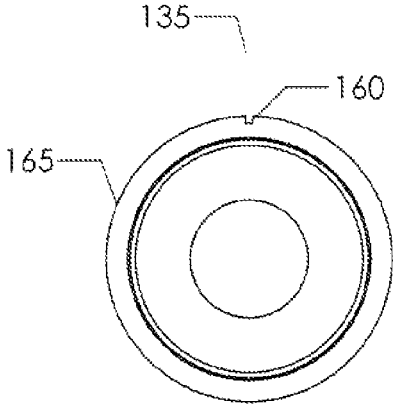
FIG. 11 is an end view of the piston shown in FIG. 10.

FIGS. 10 and 11 represent a second embodiment of piston (135) utilized in FIG. 9. Head (165) of piston (135) acts as a seal against bore (155) of tubular housing (130). Weep hole(s) (160) can be any number and size of groove(s) on the sealing surface of head (165) of piston (135), rather than having a number of weep holes (160) through head (165) of piston (135). As can be seen in FIGS. 10 and 11, weep holes 160 comprise longitudinal holes or grooves in the outer surface of piston 135, permitting fluid flow around head 165 of piston 135. Fluid from bore (155) can then bypass the sealing surface of head (165) by traveling through the number of weep holes (165) on head (165) of piston (135). In lieu of or in addition to weep holes 160, a number of grooves (not shown) may also be utilized within bore (155)

of tubular housing (130) to allow for the bypass of fluid around head (165) of piston (135).

Figure 12:
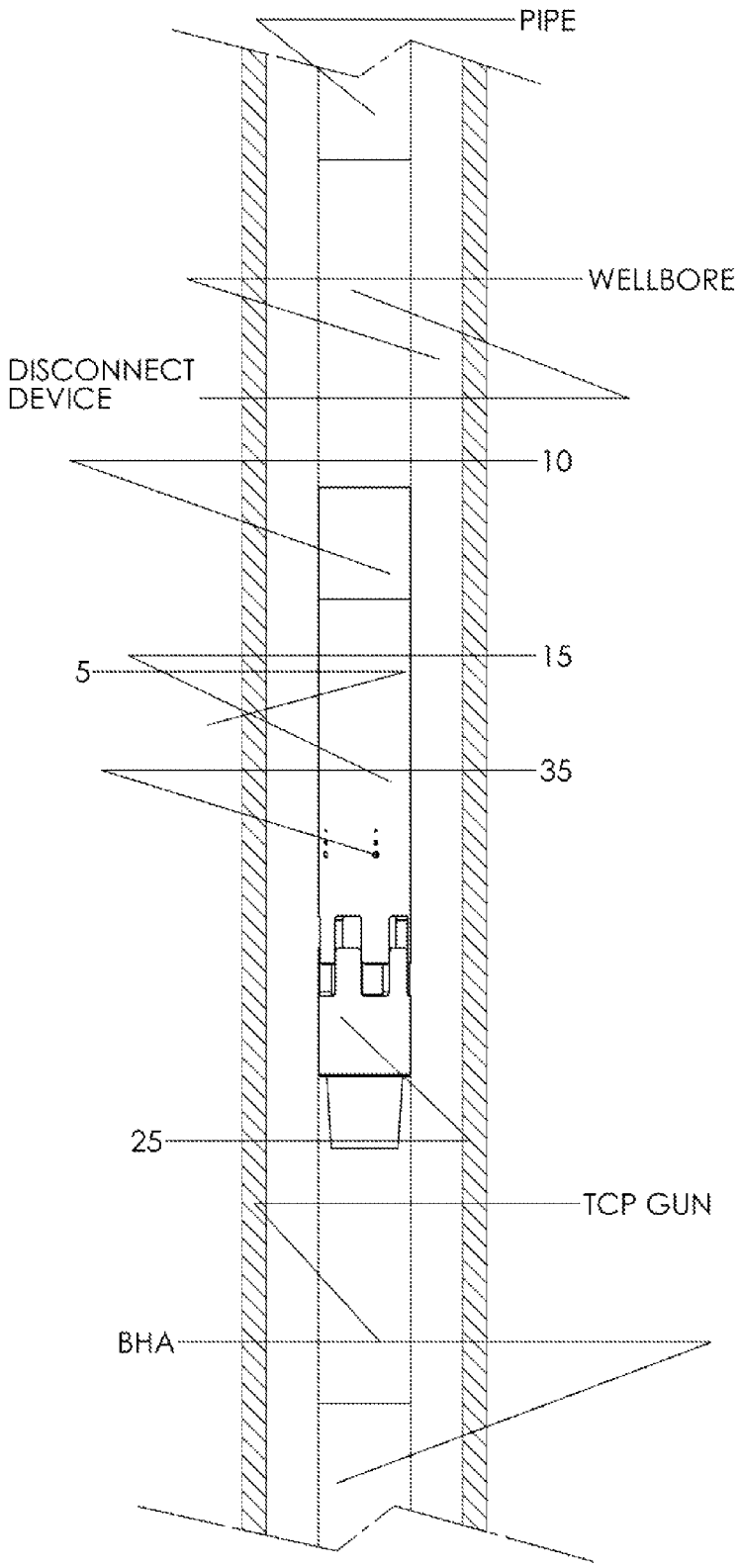
FIG. 12 is a cross sectional view of an impact dampening apparatus shown in a wellbore.

FIG. 12 shows an impact dampening apparatus (5) within a wellbore. Upper sub (10) is threadably attached to a disconnect device (labeled) on the upper end of impact dampening apparatus (5). The disconnect device is in turn made up to a string of pipe (labeled) or tubular string, to be lowered into a well bore (labeled). Bottom sub (25) is threadably attached to a TCP gun (labeled) or other impact device on its lower end. The impact dampening apparatus (5) is placed on the tool string so that the TCP gun or other impact device will effectively place an impact force on the BHA without effecting the tool string or pipe above it.

CONCLUSION

While the foregoing description provides a number of details regarding the present invention, same are presented by way of example only and not limitation. Changes can be made to the apparatus and/or method of its use, as will be recognized by those skilled in the relevant art field, without departing from the scope of the invention.

Therefore, the scope of the invention is not to be defined by the exemplary embodiments given, but by the appended claims and their legal equivalents.

I claim:

1. An apparatus for dampening vibrations in a drillstring, comprising:

a tubular housing having first and second ends and comprising an upper sub connected at said first end, said tubular housing and said upper sub having a bore therethrough;

a piston disposed in said bore of said tubular housing and longitudinally movable therein, the dimensions of said piston and said bore permitting limited fluid flow therearound;

a bottom sub attached to said piston and positioned outside of said tubular housing, proximal said second end of said tubular housing, wherein said bottom sub and said tubular housing comprise mating profiles which rotationally lock said bottom sub and said tubular housing together but permit longitudinal movement therebetween; and a spring member disposed within said tubular housing which biases said piston and said bottom sub away from said tubular housing.

2. The apparatus of claim 1, wherein said tubular housing comprises one or more port holes permitting fluid communication between said bore of said tubular housing and the exterior of said tubular housing, said one or more port holes positioned between said piston and said first end of said tubular housing.

3. The apparatus of claim 2, wherein said one or more port holes comprises a plurality of port holes spaced along a length of said tubular housing, said port holes presenting decreasing flow area in a direction toward said first end of said tubular housing.

4. The apparatus of claim 1, wherein said mating profiles comprise fingers in said tubular housing and said bottom sub.

5. The apparatus of claim 1, further comprising an elastomeric member disposed within said tubular housing, against which said piston bears when said piston moves in said bore toward said first end.

6. The apparatus of claim 5, wherein said tubular housing comprises one or more port holes permitting fluid communication between said bore of said tubular housing and the exterior of said tubular housing, said one or more port holes positioned between said piston and said first end of said tubular housing.

7. The apparatus of claim 6, wherein said one or more port holes comprises a plurality of port holes spaced along a length of said tubular housing, said port holes presenting decreasing flow area in a direction toward said first end of said tubular housing.

8. The apparatus of claim 1, wherein said bore of said tubular housing comprises a compressible fluid biasing said piston outwardly from said tubular housing.

9. The apparatus of claim 1, wherein said piston further comprises one or more weep holes therein, said weep holes comprising longitudinal grooves in a head portion of said piston.

10. An apparatus for dampening vibrations in a drillstring, comprising:

a tubular housing having first and second ends and comprising an upper sub connected at said first end, said tubular housing and said upper sub having a bore therethrough, said upper sub comprising a threaded connection for connecting said apparatus to a tubular string;

a piston disposed in said bore of said tubular housing and longitudinally movable therein, the dimensions of said piston and said bore permitting limited fluid flow therearound;

a bottom sub attached to said piston and positioned outside of said tubular housing, proximal said second end of said tubular housing, wherein said bottom sub and said tubular housing comprise mating profiles which rotationally lock said bottom sub and said tubular housing together but permit longitudinal movement therebetween;

a spring member disposed within said tubular housing which biases said piston and said lower sub away from said tubular housing;

wherein said tubular housing comprises one or more port holes permitting fluid communication between said bore of said tubular housing and the exterior of said tubular housing, said one or more port holes positioned between said piston and said first end of said tubular housing.

11. The apparatus of claim 10, wherein said one or more port holes comprises a plurality of port holes spaced along a length of said tubular housing, said port holes presenting decreasing flow area in a direction toward said first end of said tubular housing.

12. The apparatus of claim 11, wherein said mating profiles comprise fingers in said tubular housing and said bottom sub.

13. The apparatus of claim 10, wherein said mating profiles comprise splines in said tubular housing and said bottom sub.

14. The apparatus of claim 10, further comprising an elastomeric member disposed in said tubular housing, against which said piston bears when said piston moves in said bore toward said first end.

15. The apparatus of claim 10, wherein said spring member comprises a metal coil spring.

16. An apparatus for dampening vibrations in a drillstring, comprising:

a tubular housing having first and second ends and comprising an upper sub connected at said first end, said tubular housing and said upper sub having a bore therethrough;

a piston disposed in said bore of said tubular housing and longitudinally movable therein, the dimensions of said piston and said bore permitting limited fluid flow therearound;

a bottom sub attached to said piston and positioned outside of said tubular housing, proximal said second end of said tubular housing, wherein said bottom sub and said tubular housing comprise mating profiles which rotationally lock said bottom sub and said tubular housing together but permit longitudinal movement therebetween; and an elastomeric member disposed within said tubular housing, against which said piston bears when said piston moves in said bore toward said first end.

17. The apparatus of claim 16, wherein said tubular housing comprises one or more port holes permitting fluid communication between said bore of said tubular housing and the exterior of said tubular housing, said one or more port holes positioned between said piston and said first end of said tubular housing.

18. An apparatus for dampening vibrations in a drillstring, comprising:

a tubular housing having first and second ends and comprising an upper sub connected at said first end, said tubular housing and said upper sub having a bore therethrough;

a piston disposed in said bore of said tubular housing and longitudinally movable therein, the dimensions of said piston and said bore permitting limited fluid flow therearound; and a bottom sub attached to said piston and positioned outside of said tubular housing, proximal said second end of said tubular housing, wherein said bottom sub and said tubular housing comprise mating profiles which rotationally lock said bottom sub and said tubular housing together but permit longitudinal movement therebetween, and wherein said bore of said tubular housing comprises a compressible fluid biasing said piston outwardly from said tubular housing.

19. The apparatus of claim 18, wherein said tubular housing comprises one or more port holes permitting fluid communication between said bore of said tubular housing and the exterior of said tubular housing, said one or more port holes positioned between said piston and said first end of said tubular housing.

20. An apparatus for dampening vibrations in a drillstring, comprising:

a tubular housing having first and second ends and comprising an upper sub connected at said first end, said tubular housing and said upper sub having a bore therethrough;

a piston disposed in said bore of said tubular housing and longitudinally movable therein, the dimensions of said piston and said bore permitting limited fluid flow therearound; and a bottom sub attached to said piston and positioned outside of said tubular housing, proximal said second end of said tubular housing, wherein said bottom sub and said tubular housing comprise mating profiles which rotationally lock said bottom sub and said tubular housing together but permit longitudinal movement therebetween, and wherein said piston further comprises one or more weep holes therein, said weep holes comprising longitudinal grooves in a head portion of said piston.

* * * * *